US005556143A

United States Patent [19]

Robinson

[11] Patent Number: 5,556,143

[45] Date of Patent: Sep. 17, 1996

[54] DOOR SECURITY APPARATUS

[76] Inventor: Joseph N. Robinson, 158 Eaton St., Buffalo, N.Y. 14208

[21] Appl. No.: 406,633

[22] Filed: Mar. 20, 1995

Related U.S. Application Data

[62] Division of Ser. No. 230,604, Apr. 21, 1994, abandoned.

[51] Int. Cl.[6] ..... B05C 19/00

[52] U.S. Cl. ..... 292/302; 292/288; 292/259 R; 292/289

[58] Field of Search ..... 292/288, 289, 292/259 R, 339, 292, 295

[56] References Cited

U.S. PATENT DOCUMENTS

| | | | |
|---|---|---|---|
| 720,496 | 2/1903 | Simpson . | |
| 1,571,024 | 1/1926 | Scheid . | |
| 2,373,783 | 4/1945 | Schlifer | 70/101 |
| 3,206,793 | 9/1965 | Silverberg | 292/288 |
| 3,583,738 | 6/1971 | Uphoff | 292/67 |
| 3,767,167 | 10/1973 | Rasmussen | 256/26 |
| 3,806,179 | 4/1974 | Roessle | 292/259 R |
| 3,809,417 | 5/1974 | Craig | 292/259 |
| 3,821,884 | 7/1974 | Walsh | 292/259 R X |
| 3,955,841 | 5/1976 | Walker | 292/259 R |
| 3,986,741 | 10/1976 | Giovannini | 292/259 R X |
| 4,429,911 | 2/1984 | O'Neal et al. | 292/259 R |
| 4,462,625 | 7/1984 | Barnhill | 292/259 R |
| 4,844,519 | 7/1989 | Dagon | 292/57 |
| 5,010,747 | 4/1991 | Norden, Jr. | 292/259 R X |
| 5,026,102 | 6/1991 | Pitman | 292/259 R |

OTHER PUBLICATIONS

The Harry Engert Company, "Engart's Sliding Door Latch", Jul. 1980.

*Primary Examiner*—Steven N. Meyers
*Assistant Examiner*—Monica E. Millner
*Attorney, Agent, or Firm*—Hodgson, Russ, Andrews, Woods & Goodyear, LLP

[57] ABSTRACT

An inexpensive and easy to install and use door security apparatus which comprises a bar extending, in a first position, across the width of the inner side of the door and having end portions which extend beyond the door edges respectively. Brackets attached to the frame portions hold the end portions against the respective frame portions to counteract a force applied to the outer side of the door during an attempted forced entry. A handle is attached to the bar for pivoting it to another position clear of the door so that the door can be opened. The handle extends through the respective frame portion so that it may be operated from the outer side of a door and is lockingly secured to prevent unauthorized persons from operating the handle. In accordance with another aspect of the present invention, at least two locking assemblies are provided with at least one locking assembly provided along each vertical edge of the door. Each of the locking assemblies comprises a pair of members one of which is attached to the door adjacent the respective edge and the other of which is attached to the respective frame portion. The two members are positioned relative to each other so that their barrels removably receive respective legs of a U-shaped bolt to thusly lockingly attach the members together to prevent unauthorized entry.

8 Claims, 4 Drawing Sheets

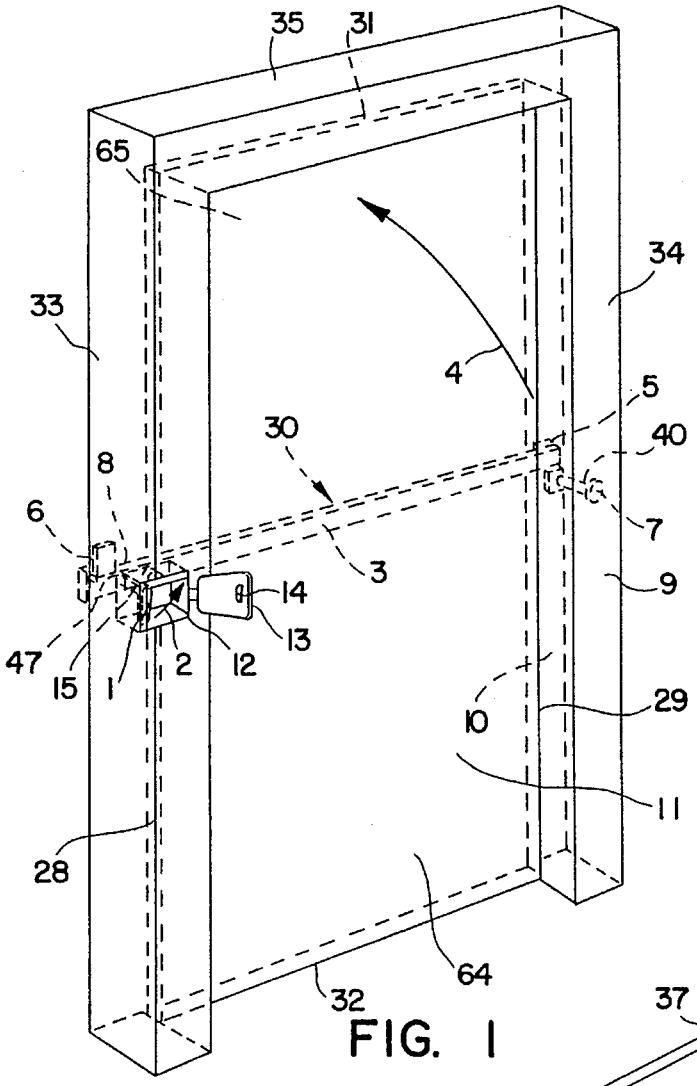
FIG. 1
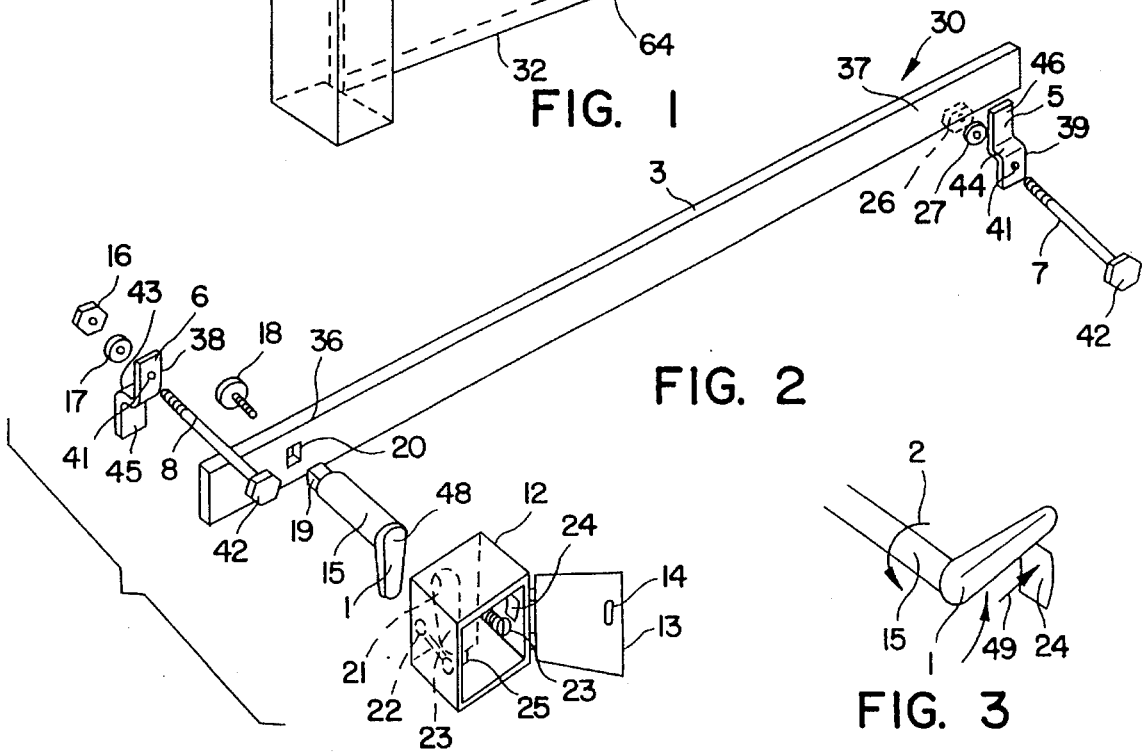
FIG. 2
FIG. 3

DOOR SECURITY APPARATUS

This application is a divisional of application Ser. No. 08/230,604 filed Apr. 21, 1994, now abandoned.

The present invention relates generally to door security apparatus. More particularly, the present invention relates to apparatus for preventing the forced entry of a locked door.

Entry to a locked door may be obtained by removing the hinge pins or by forcefully overcoming or picking the lock. It has been suggested to install a bar which extends across the inner side of the door to hold the door against forcible entry. For example, U.S. Pat. No. 3,806,179 to Roessle discloses a bar which spans a door and door frame tying them together and is mounted at one end in one of the door hinges. A lock assembly is operable from the outside and extends through the door and frame assembly to engage or disengage the bar. For another example, U.S. Pat. No. 2,373,783 to Schlifer discloses a locking bar positionable across a door on the inside and which may be released from the outside by a lock. Thus, the end adjacent the swinging edge of the door is lockably secured to a locking tongue attached to the door frame, and the other end is pivotally secured to the door frame so that, when released and upon opening of the door, the locking bar moves with the door. The door is provided with brackets to secure the bar alongside the door whereby it may engage the locking tongue upon closing the door. U.S. Pat. Nos. 3,809,417 to Craig and 4,429,911 to O'Neal et al also disclose the use of bars which span a door on the inside and which are secured at each end to the door frame. However, these patents do not disclose means for securing or releasing the bars from the outside. U.S. Pat. No. 3,821,884 to Walsh discloses a multiple-locking bar arrangement for securing a sliding glass door.

The locking bar arrangements of the above patents suffer from various drawbacks. Such arrangements are either expensive to manufacture, difficult to install and operate, or, as in the Craig and O'Neal et al apparatus, have limited usefulness in that the bars thereof are not operable from the outside of a door.

It has also been suggested to use locking pins for securing a locked door against forced entry. For example, U.S. Pat. No. 4,844,519 to Dagon discloses a door lock comprising a pair of members secured to the sidewall of a door jam and to the sidewall of a door adjacent its swinging edge respectively. The members have axially alignable channels in which is insertable a locking pin. The locking pin requires precise alignment by predetermined rotation thereof for insertion and withdrawal and cannot be withdrawn without knowing how to properly rotate for the correct alignment.

U.S. Pat. No. 720,496 to Simpson discloses a sash fastener wherein a U-shaped pin has a leg insertable in one of a series of holes formed in the stile of an upper sash and has another leg insertable into a corresponding one of a series of holes formed in the inside lining and edge of the pulley-stile of the window frame. This allows the sashes to be secured in any predetermined position and in such a manner that the window cannot be operated except from the inside of the premises by removal of the U-shaped pin.

U.S. Pat. No. 1,571,024 to Scheid discloses a window lock comprising a U-shaped pin each leg of which is insertable through a sleeve of a member attached to the top rail of a lower sash and into any pair of a series of pairs of holes in the top sash so that the sashes may be locked at any of various points within their path of travel.

Also see U.S. Pat. No. 3,767,167 to Rasmussen which discloses a portable fence panel utilizing U-shaped studs one leg of each of which is mounted to an end post and the other leg of each of which fits tubes mounted to another end post to provide a four-way fence corner.

While the above pin locking arrangements are suitable for their intended purposes, they do not provide a suitable mechanism or assembly for installation on the inside of a locked door which is inexpensive and easy to install and operate and effective for preventing forced entry of the locked door.

It is accordingly an object of the present invention to provide an effective door security apparatus which is inexpensive and easy to install and use.

It is an object of an aspect of the present invention to provide such an apparatus which is operable from the outside of a locked door.

In accordance with one aspect of the present invention, a bar is provided which extends across the width of the door and extends beyond the door edges, and brackets or other suitable means are provided for holding the bar end portions against the frame to counteract a force applied to the other side of the door during an attempted forced entry. A handle is attached to one of the end portions and extends through the frame for manipulation from the outside of the door for pivoting the bar to a position clear of the door so that the door can be opened. The handle is lockingly secured in order to prevent unauthorized persons from operating the handle.

In accordance with another aspect of the present invention, apparatus for securing a door against forced entry comprises at least two locking assemblies wherein at least one of the assemblies connects the hinged door edge to the frame and the other of the assemblies connects the swinging door edge to the frame. Each of the assemblies includes a pair of members one of which is attached to the door and the other of which is attached to the frame and which have barrels in which are received respective leg portions of a U-shaped bolt. Preferably at least four such assemblies are provided, two for the hinged edge and two for the swinging edge, and the two for each edge being spaced apart along the edge length a distance equal to at least one-half of the edge length.

The above and other objects, features, and advantages of the present invention will be apparent in the following detailed description of the preferred embodiments thereof taken in conjunction with the accompanying drawings wherein the same reference numeral denotes the same or similar parts throughout the several views.

BRIEF DESCRIPTION OF THE DRAWINGS

FIG. 1 is a perspective view of a door security apparatus in accordance with one embodiment of the present invention, the door and frame being shown in phantom lines with a portion of the apparatus illustrated on the opposite side of the door.

FIG. 2 is a blown-up enlarged view of the apparatus of FIG. 1.

FIG. 3 is a partial enlarged view of the apparatus of FIG. 1.

DETAILED DESCRIPTION OF THE PREFERRED EMBODIMENTS

Figure 9:
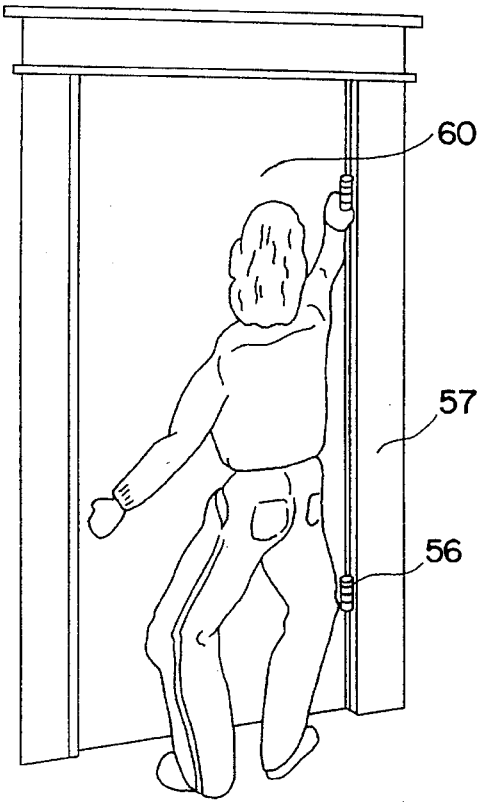
FIG. 9 is a perspective view illustrating the removal of hinge pins from a door for the purposes of forced entry.
Figure 10:
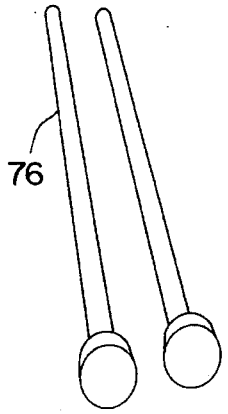
FIG. 10 is a perspective view of a pair of hinge pins for the door of FIG. 9.
Figure 11:
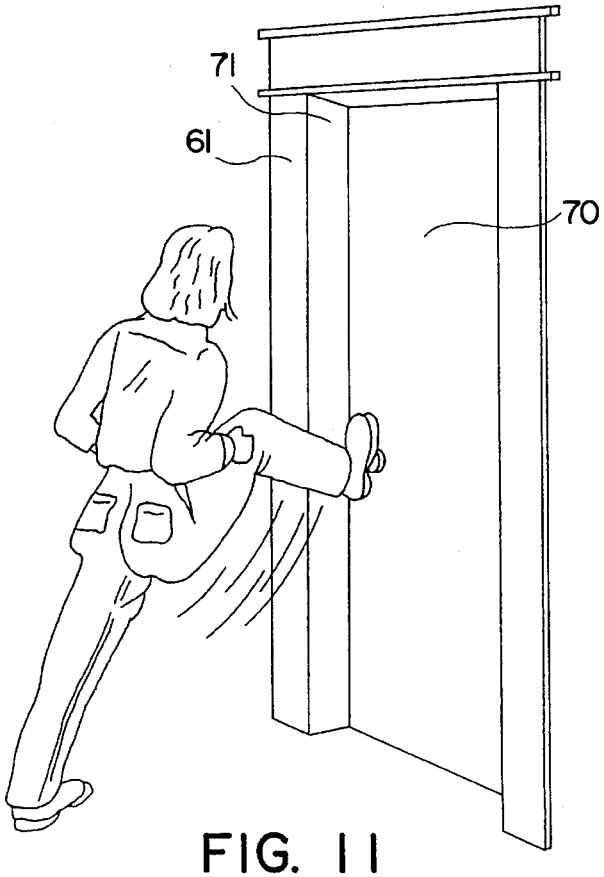
FIG. 11 is a perspective view illustrating another means of forced entry.

FIG. 9 illustrates the unauthorized entry of an outwardly swinging locked door 60 by the removal of the hinge pins, illustrated at 76 in FIG. 10, from the hinges 56 thereof. FIG. 11 illustrates an inwardly swinging door 70 wherein the hinges would not be accessible to a burglar. However, as FIG. 11 illustrates, forced entry may still be obtained by kicking the door or otherwise applying sufficient force to overcome the holding power of a conventional lock. The door security apparatus of the present invention is provided to prevent the type of forcible or unauthorized entry illustrated in FIGS. 9 and 11.

Referring to FIGS. 1 and 2, there is illustrated generally at 30 a door security apparatus in accordance with one embodiment of the present invention for preventing the forced or unauthorized entry illustrated in FIGS. 9 and 11. In FIG. 1 the apparatus 30 is shown in connection with a door 11 of the inwardly swinging type which is hingedly attached to a door casing or frame 9. The door 11 has an outer side, illustrated at 64, an inner side, illustrated at 65, a hinged vertical edge 29, a swinging vertical edge 28 parallel to edge 29, and upper and lower horizontal parallel edges 31 and 32. By "hinged edge" is meant the door edge which is connected to the frame by means of hinges 56. The door frame 9 includes a pair of parallel vertical frame portions 33 and 34 which are adjacent the edges 28 and 29 respectively and a horizontal frame portion 35 adjacent the upper door edge 31. At 10 is illustrated the inner edge of the frame portion 34.

Apparatus 30 includes a bar 3 composed of a suitable material such as steel to resist forced entry of the door and has a length to extend across the width of the door 11 and beyond the door edges 28 and 29 so that the end portions 36 and 37 overlie the frame portions 33 and 34 respectively.

Suitable brackets or bar rests 6 and 5 are suitably attached to the inside surface of the frame portions 33 and 34 respectively for holding the bar end portions 36 and 37 respectively against the frame portions to counteract a force applied to the other side of the door, which is the outer side 64, during an attempted forced entry. The brackets have generally flat first portions 38 and 39 for brackets 6 and 5 respectively which engage the inner surfaces of the frame portions 33 and 34 respectively and are attached thereto by suitable means such as bolts 8 and 7 respectively which are inserted through holes, illustrated at 40 for bolt 7, in the respective frame portion and through holes 41 in the respective bracket portions 38 and 39 and secured by means of nut and lock washer 26 and 27 respectively for bolt 7 and nut and lock washer 16 and 17 respectively for bolt 8. The bolt heads 42 are preferably countersunk into the respective frame portion and covered with a filler so that they are not apparent to a burglar.

With the brackets 6 and 5 suitably attached to their respective frame portions, second portions 43 and 44 respectively thereof, normal to first portions 38 and 39 respectively, extend outwardly from the respective frame portion. Portion 43 extends from the lower edge of portion 38, and portion 44 extends from the upper edge of portion 39.

The brackets also include third portions 45 and 46 which extend from the outer edges of the respective second portions 43 and 44 parallel to the first portions 38 and 39 respectively so as to be parallel to and spaced from the frame portions 33 and 34 respectively. Portion 45 extends downwardly from portion 43, and portion 46 extends upwardly from portion 44. When the brackets are installed, the portions 45 and 46 are spaced from the respective frame portions 33 and 34 respectively a distance slightly greater than the thickness of the bar 3 so as to receive the end portions 36 and 37 respectively of the bar between respective portions 45 and 46 and the respective frame portions 33 and 34 so that the brackets can hold the bar 3 in position across the inner side of the door to resist any force applied to gain entry through the door.

A bar control handle 1 has a stem 15 the end portion 19 of which has a square cross-section for engaging a square hole 20 through the bar 3 and is suitably secured thereto by a large head security screw 18. The stem 15 is suitably attached to the bar end portion 36 so that the stem 15 extends therefrom normal to the longitudinal direction of the bar 3. With the exception of the end portion 19, the stem 15 is cylindrical in shape and passes through a hole, illustrated at 47, of complementary dimension in the frame portion 33, whereby the hole 47 acts as a bearing for rotation of the stem 15 therein, to present the handle to the outside of the frame portion 33 for manipulation by someone from outside the locked door. Thus, the bar 3 is held in horizontal position across the width of the door by the stem 15 and with the bar end portion 37 resting on the bracket portion 44 and the other bar end portion 36 engaging the lower surface of bracket portion 43.

By rotation of the handle 1 in a counterclockwise direction, illustrated at 2, pivoting movement of the bar is effected about the axis of handle stem 15 also in a counterclockwise direction, as illustrated at 4, with the bar end portion 37 moving upwardly away from bracket 5 and the end of the bar 3 corresponding to end portion 36 moving downwardly away from bracket 6 so that the bar 3 is no longer held adjacent the frame by the brackets. By pivoting movement of the bar 3 through about 90 degrees, the bar is brought to a vertical position adjacent over its length the frame portion 33 clear of the door 11 so that the door may be opened without being restrained by the bar 3. A suitable lock box 12 is suitably attached to the frame portion 33 by suitable means such as a pair of screws 23 which pass through apertures, illustrated at 22, in the back wall of the lock box and threadedly engage the frame portion 33 to secure the rear wall of the lock box to the frame portion 33. The handle 1 passes through an elongate hole 21 in the back wall of the box for entry into the box. The box 12 is closed by means of a hinged front lid or door 13 which is locked by suitable means such as a lock device, illustrated at 14, including a tongue which is received in a port, illustrated at 25, to thus prevent access to the handle 1 by an unauthorized person.

A spring lock member 24 or other suitable means is preferably provided to hold the handle 1 in position so that the bar 3 remains in an upright or vertical position when not in use. The spring 24 is releasable to effect pivoting movement of the bar 3 into the horizontal position across the door width in order to secure the door against unauthorized or forced entry. The spring 24 holds the handle 1 in position, as shown in FIG. 3, to maintain the bar 3 in the upright position when not in use and is released, as illustrated by arrow 49, out of the way of handle 1 for clockwise rotation thereof so that the bar 3 is pivoted into the horizontal position across the door as shown in FIG. 1 to secure the door against forced or unauthorized entry.

Thus, there is provided a door security apparatus, illustrated in FIGS. 1 to 3, which is inexpensive to manufacture and easy to install and use to be effective against forced or unauthorized entry.

Figure 4:
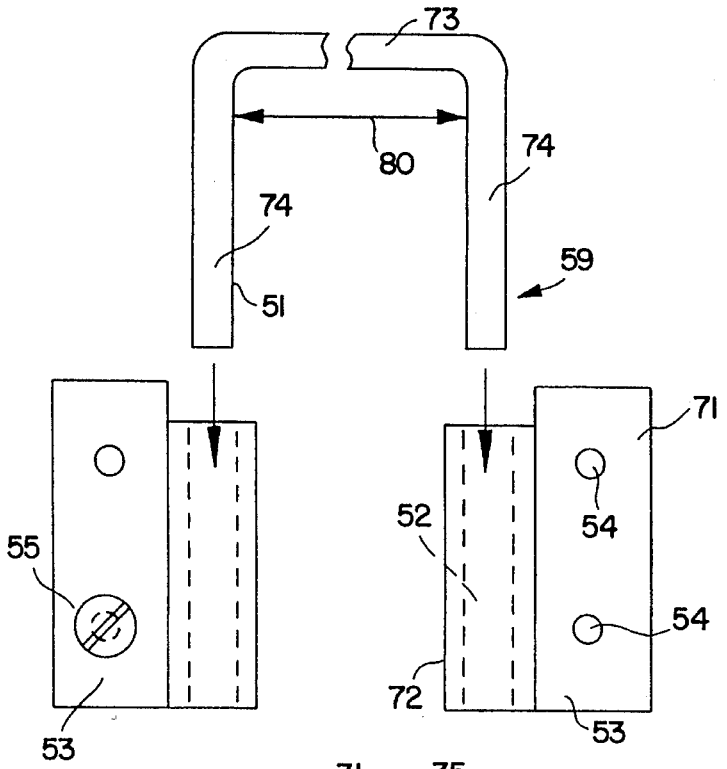
FIG. 4 is a plan view of a locking assembly for a door security apparatus in accordance with an alternative embodiment of the present invention.
Figure 5:
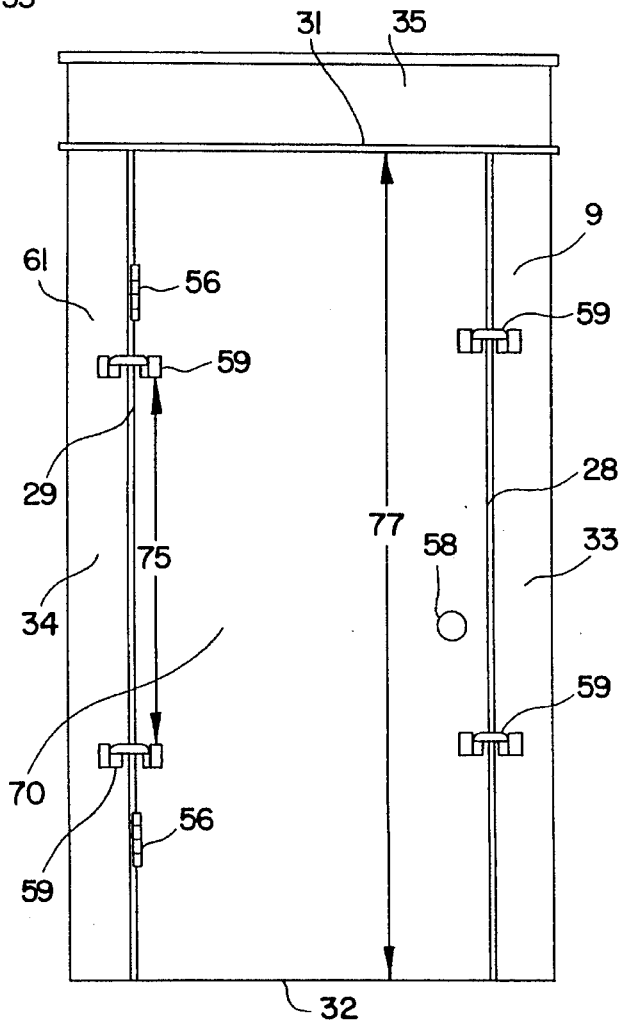
FIG. 5 is a side view of a door and frame illustrating the attachment of a plurality of the assemblies of FIG. 4 thereto.

Referring to FIGS. 4 and 5, there is illustrated generally at 59 a plurality of at least two assemblies each of which is attached to door 70 and frame 9 for securing the door against forced or unauthorized entry. The door in FIG. 5 is shown to be an inwardly swinging door having a door knob 58 and a pair of hinges 56 hingedly connecting the door edge 29 to the frame portion 34.

Each of the assemblies 59 includes a pair of members 53 each having a generally flat portion 71 having suitable means such as a pair of apertures 54, which are drilled, punched, or otherwise suitably provided therein for receiving suitable screws one shown at 55 for attachment to the door or frame. Integral with the plate 71 is a barrel portion 72 having an elongate aperture 52 therein.

The assembly 59 also includes a C-shaped or U-shaped bolt 51 having an intermediate portion 73 and a pair of leg portions 74 which are insertable in the apertures 52. The members 51 and 53 are composed of steel or other material suitable for resisting forced entry.

Figure 8:
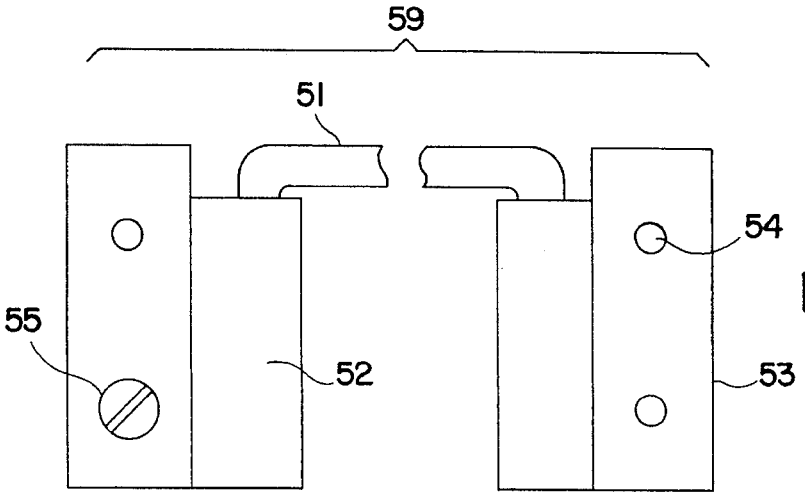
FIG. 8 is a view similar to that of FIG. 4 illustrating the assembly of FIG. 4 with the bolt inserted.

At least one of the assemblies 59 is attached to frame portion 33 and the door adjacent edge 28, and at least one of the assemblies 59 is attached to frame portion 34 and the door adjacent the edge 29 so that the door can resist forcible entry along both vertical edges 28 and 29. One of the members 53 of each assembly 59 is attached to the inner side of the door 70 adjacent the respective edge 28 or 29, and the other member 53 is secured to the respective frame portion 33 or 34 in position with the apertures 52 aligned so that the aperture of one of the members 53 receives one leg 74 of the bolt 51 and the aperture 52 of the other member 53 receives the other leg 74 of bolt 51, as illustrated in FIG. 8, whereby the bolt 51 may be easily inserted into the apertures 52 to connect the door to the respective frame portion for resisting forced entry yet the bolt 51 may be easily removed therefrom so that the door may be opened. The distance, illustrated at 80, between the leg portions 74 is preferably between about 1½ and 4 inches, more preferably equal to about 2 inches.

It is preferred that the door 70 be securable to the frame by at least two assemblies 59 along edge 28 and at least two assemblies 59 along edge 29. It is also preferred that two of the assemblies 59 along an edge be spaced apart a distance, illustrated at 75, which is equal to at least half of the length, illustrated at 77, of each of the door edges 28 and 29 in order that the restraining forces may be evenly applied along the height of the door.

Figure 6:
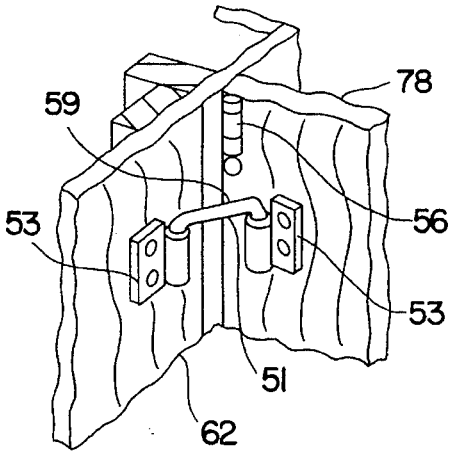
FIG. 6 is a perspective view illustrating an alternative embodiment of the assembly of FIG. 4 attached to a door and frame which are at right angles to each other.

Referring to FIG. 6, there is illustrated a portion of an inwardly swinging door 78 hingedly connected to a casing portion 62 which is normal thereto. As shown in FIG. 6, the members 53 may be suitably attached to such a structure for receiving the U-shaped bolt 51.

Figure 7:
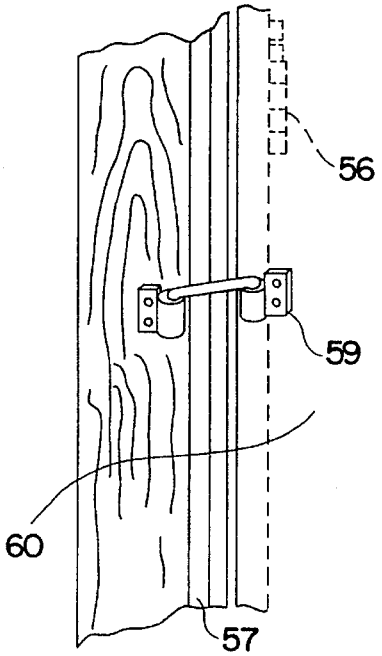
FIG. 7 is a view similar to that of FIG. 6 illustrating another embodiment of the assembly of FIG. 4.

FIG. 7 shows another embodiment for use of the security assemblies 59 wherein a portion of outwardly swinging door 60 is hingedly connected to casing portion 57.

It should be apparent that both the bar security apparatus 30 of FIGS. 1 to 3 and the plurality of security assemblies 59 of FIGS. 4 to 8 may be provided on the same door to afford extra security. Thus, there is provided apparatus for production inexpensively and for easy installation and use for providing security against forced or unauthorized entry of a door.

It is to be understood that the invention is by no means limited to the specific embodiments which have been illustrated and described herein, and that various modifications thereof may indeed be made which come within the scope of the present invention as defined by the appended claims.

What is claimed is:

1. In combination with a door having outer and inner sides and a pair of parallel edges and a door frame having a pair of parallel portions disposed adjacent the parallel edges respectively when the door is closed, said door being hingedly connected along one of said parallel edges to one of said parallel portions of said door frame, apparatus for securing the door against forced entry comprising a bar sized to extend, in a first position, across the width of the inner side of the door and having end portions to extend beyond said door edges respectively, means for holding said bar end portions against said frame portions respectively to counteract a force applied to the outer side of the door during an attempted forced entry, means for pivoting said bar to a second position clear of the door so that the door can be opened, means for operating said pivoting means from the outer side of the door, and means for lockingly securing said operating means to prevent unauthorized persons from operating said pivoting means, said pivoting means comprising a handle attached to one of said bar end portions and extending through said one frame portion to effect pivoting movement of said bar to said second position.

2. A combination according to claim 1 further comprising means for holding said bar in said second position when the door securing apparatus is not in use.

3. A combination according to claim 1 wherein said bar holding means comprises a first bracket having a first portion attached to said one frame portion, a second portion extending normal to said one frame portion, and a third portion extending downwardly from said second portion and spaced from said first portion to receive one of said bar end portions between said third portion and said one frame portion, said bar holding means further comprising a second bracket having a first portion attached to the other of said frame portions, a second portion extending normal to said other frame portion, and a third portion extending upwardly from said second portion of said second bracket and spaced from said first portion of said second bracket to receive the other of said bar end portions between said second bracket third portion and said other frame portion.

4. In combination with a door having outer and inner sides and a pair of parallel edges and a door frame having a pair of parallel portions disposed adjacent the parallel edges respectively when the door is closed, said door being hingedly connected along one of said parallel edges to one of said parallel portions of said door frame, apparatus for securing the door against forced entry comprising a bar sized to extend, in a first position, across the width of the inner side of the door and having end portions to extend beyond said door edges respectively, means for holding said bar end portions against said frame portions respectively to counteract a force applied to the outer side of the door during an attempted forced entry, means for pivoting said bar to a second position clear of the door so that the door can be opened, means for operating said pivoting means from the outer side of the door, and means for lockingly securing said operating means to prevent unauthorized persons from operating said pivoting means, wherein said bar holding means comprising a first bracket having a first portion attached to said one frame portion, a second portion extending normal to said one frame portion, and a third portion extending downwardly from said second portion and spaced from said first portion to receiving one of said bar end portions between said third portion and said one frame portion, said bar holding means further comprising a second bracket having a first portion attached to the other of said frame portions, a second portion extending normal to said other frame portion, and a third portion extending upwardly from said second portion of said second bracket and spaced from said first portion of said second bracket to receive the other of said bar end portions between said second bracket third portion and said other frame portion, and wherein said pivoting means comprises a handle attached to said one bar end portion and extending through said one frame portion to effect pivoting movement of said bar to a vertical position with said other bar and portion moving upwardly from said second bracket, the combination further comprising spring means for holding said handle in a position so that said bar is in said second position when the door securing apparatus is not in use.

5. A combination according to claim 1 wherein said securing apparatus further comprises at least two locking assemblies one of which connects the door inner side adjacent said one edge to said one frame portion and an other of which connects the door inner side adjacent the other edge to the other frame portion.

6. Apparatus for preventing forced entry of a door comprising a bar adapted to extend, in a first position, across the width of an inner side of the door including a pair of end portions adapted to extend beyond respective edges of the door, a handle attached to one of said end portions for pivoting said bar through an angle of about 90 degrees for positioning of said bar in a second position to clear the door so that the door can be opened, said handle adapted to extend through a door frame portion for operation of said handle from an outer side of the door, a pair of brackets attachable to door frame portions respectively adjacent the door edges and adapted to hold said bar end portions respectively against the respective frame portions to counteract a force applied to the outer side of the door during an attempted forced entry, and means for lockingly securing said handle to prevent unauthorized persons from operating the handle, each of said brackets including a first portion attachable to a frame portion, a second portion normal to said first portion, and a third portion parallel to said first portion for receiving a respective bar end portion between said third portion and a respective frame portion whereby one of the brackets may be installed with the third portion thereof extending downwardly from the second portion thereof and the other of the brackets may be installed with the third portion thereof extending upwardly from the second portion thereof for upward movement of the respective bar end portion therefrom during pivoting movement of the bar, the apparatus further comprising spring means for holding said handle in a position so that said bar is in said second position when the apparatus is not in use.

7. Apparatus according to claim 6 further comprising means for holding said bar in said second position when the door securing apparatus is not in use.

8. Apparatus according to claim 6 further comprising at two locking assemblies one of which is adapted to lockingly connect the door adjacent one edge thereof to the adjacent frame portion and an other of which is adapted to lockingly connect the door adjacent the other edge thereof to the adjacent frame portion.

* * * * *